US012185834B1

(12) United States Patent
Chen

(10) Patent No.: US 12,185,834 B1
(45) Date of Patent: Jan. 7, 2025

(54) SCREW-LESS AND NO RIVET COMBINED TYPE SHELF

(71) Applicant: Protrend Co., Ltd., Taipei (TW)

(72) Inventor: Shun-Yi Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 18/389,866

(22) Filed: Dec. 20, 2023

(30) Foreign Application Priority Data

Oct. 12, 2023 (TW) ..... 112138866

(51) Int. Cl.

| | |
|---|---|
| ***A47B 57/40*** | (2006.01) |
| ***A47B 47/00*** | (2006.01) |
| ***A47B 57/34*** | (2006.01) |
| ***A47B 57/50*** | (2006.01) |
| ***A47B 87/02*** | (2006.01) |
| ***A47B 96/14*** | (2006.01) |

(52) U.S. Cl.
CPC ..... *A47B 57/40* (2013.01); *A47B 47/0083* (2013.01); *A47B 57/34* (2013.01); *A47B 57/402* (2013.01); *A47B 57/50* (2013.01); *A47B 87/0215* (2013.01); *A47B 96/1408* (2013.01)

(58) Field of Classification Search
CPC ..... A47B 57/40; A47B 57/34; A47B 96/1408; A47B 57/402; A47B 57/406; A47B 57/50; A47B 57/16; A47B 47/0083; A47B 87/0215; A47B 87/0207
USPC ..... 211/187, 192, 194, 191
See application file for complete search history.

(56) References Cited

U.S. PATENT DOCUMENTS

| | | | | | |
|---|---|---|---|---|---|
| 2,893,567 | A * | 7/1959 | Steele | A47B 57/402 | 403/345 |
| 3,127,995 | A * | 4/1964 | Mosinski | A47B 57/402 | 211/182 |
| 3,465,895 | A * | 9/1969 | Miller | A47B 57/402 | 403/353 |
| 3,637,087 | A * | 1/1972 | Denny | A47B 57/402 | 211/192 |
| 3,647,080 | A * | 3/1972 | Denny | A47B 47/027 | 108/901 |
| 4,197,952 | A * | 4/1980 | De Fouw | A47B 47/021 | 211/208 |
| 4,287,994 | A * | 9/1981 | Klein | A47B 57/402 | 403/254 |
| 4,423,817 | A * | 1/1984 | Monjo-Rufi | A47B 57/30 | 211/187 |
| 4,618,064 | A * | 10/1986 | Viklund | A47B 57/40 | 248/222.13 |

(Continued)

*Primary Examiner* — Jennifer E. Novosad
(74) *Attorney, Agent, or Firm* — WPAT, PC

(57) ABSTRACT

A screw-less and no rivet combined type shelf includes post components, storage layers and connecting components. Each of the post components includes four plates, trapezoidal holes and at least one bent plate. The four plates are connected together. The trapezoidal holes are disposed at one of the four plates. The bent plate is bent into one corresponding trapezoidal hole. Each of the connecting components is disposed to one corresponding storage layer. The connecting components are to assemble the storage layers within the post components. Each of the connecting components includes at least one hook piece as a slope piece. When the hook piece is inserted into the corresponding trapezoidal hole in an upright assembly direction, the hook piece is buckled in the corresponding trapezoidal hole.

6 Claims, 13 Drawing Sheets

(56) References Cited

U.S. PATENT DOCUMENTS 4,796,541 A * 1/1989 Halstrick ..... A47B 57/402 108/107
4,928,834 A * 5/1990 Neiman ..... A47B 57/402 211/208
5,190,172 A * 3/1993 Tyson ..... A47B 57/402 211/192
5,463,966 A * 11/1995 Nilsson ..... F16B 12/34 108/193
6,920,831 B2 * 7/2005 Lin ..... A47B 57/408 211/187
7,044,312 B2 * 5/2006 Yang ..... A47B 57/40 211/187
8,172,098 B2 * 5/2012 Eustace ..... A47B 57/22 211/189
8,695,816 B2 * 4/2014 Troyner ..... A47B 96/1441 211/187
9,027,767 B2 * 5/2015 Buckley ..... A47B 57/34 211/134
11,026,509 B2 * 6/2021 Walker ..... A47B 47/0083
2004/0045921 A1 * 3/2004 Muller ..... A47B 87/005 211/187
2007/0062898 A1 * 3/2007 Choi ..... A47B 57/408 211/187
2014/0175036 A1 * 6/2014 Troyner ..... A47B 57/402 211/183
2015/0359331 A1 * 12/2015 Troyner ..... A47B 96/06 211/183
2017/0280875 A1 * 10/2017 Buckley ..... A47B 57/34
2019/0029416 A1 * 1/2019 Lu ..... A47B 57/50
2021/0337964 A1 * 11/2021 Williams ..... A47B 57/34
2022/0378195 A1 * 12/2022 Chen ..... A47B 47/0058
2023/0129296 A1 * 4/2023 Chakraborthy .... A47B 47/0083 211/134
2024/0008641 A1 * 1/2024 Briosi ..... A47B 57/482

* cited by examiner

SCREW-LESS AND NO RIVET COMBINED TYPE SHELF

CROSS REFERENCE TO RELATED APPLICATION

This application claims the benefits of Taiwan application Serial No. 112138866, filed on Oct. 12, 2023, the disclosures of which are incorporated by references herein in its entirety.

TECHNICAL FIELD

The present disclosure relates in general to a screw-less and no rivet combined type shelf.

BACKGROUND

The screw-less and no rivet combined type shelf can be randomly combined to meet various needs of home, offices and other occasions. Traditionally, the shelf can be roughly classified as a round-column (or round-tube) type or a square-column (or square-tube) type. If the round-column structuring is applied, the shelf would be hard to be assembled horizontally, an extension thereof would be infeasible. Thus, generally, the square-column structuring is advantageous in constructing the shelf.

However, storage racks formed by traditional square column are generally fixed with rivets or screws, which is inconvenient to both assemble and disassemble, and thus the usability is substantially reduced. In addition, the overall screw-less and no rivet combined type shelf would add many accessories, from which a time-consuming, complicated and inconvenient assembly is inevitable. Obviously, disadvantages such as multiple production, tedious processing and packaging, and higher cost would be problems.

Therefore, how to improve the problems encountered by conventional methods will be one of the issues to be solved in the art.

SUMMARY

An object of the present disclosure is to provide a screw-less and no rivet combined type shelf whose screw-less and rivet-free assembly structure requires fewer accessories, is fast and conveniently assembled, and is able to achieve an overall screw-less and no rivet combined type shelf. In addition, since the product shelf has a simple and stable structure, is easy to use, has few accessories, has an advantage of less packaging materials, and thus is suitable for mass production.

In this disclosure, a screw-less and no rivet combined type shelf includes a plurality of post components, at least one storage layer and a plurality of connecting components. Each of the plurality of post components includes four plates, a plurality of trapezoidal holes and at least one bent plate. The four plates are connected together. The plurality of trapezoidal holes are disposed at one of the four plates. Each of the at least one bent plate is bent into one corresponding trapezoidal hole of the plurality of trapezoidal holes. Each of the plurality of connecting components is disposed to one corresponding storage layer of the at least one storage layer. The plurality of connecting components are to assemble each of the at least one storage layer within the plurality of post components. Each of the plurality of connecting components includes at least one hook piece as a slope piece. When each of the at least one hook piece is inserted into the corresponding trapezoidal hole in an upright assembly direction, each of the plurality of hook pieces is buckled in the corresponding trapezoidal hole.

In one embodiment of this disclosure, each of the plurality of trapezoidal holes has a first width and a second width in the upright assembly direction, and the first width is greater than the second width.

In one embodiment of this disclosure, each of the at least one bent plate is a slope piece.

In one embodiment of this disclosure, the hook piece includes a first hook piece and a second hook piece, and the first hook piece and the second hook piece are separated by a distance.

In one embodiment of this disclosure, each of the plurality of connecting components includes a fixing piece and a bent connecting piece, a side of the bent connecting piece is connected to the fixing piece, another side of the bent connecting piece is connected to the hook piece, and the hook piece and the fixing piece are separated by a distance.

In one embodiment of this disclosure, the hook piece is not parallel to the fixing piece.

In one embodiment of this disclosure, each of the plurality of connecting components includes a resisting piece, and the resisting piece connects with and extends from a side of the bent connecting piece.

As stated, the screw-less and no rivet combined type shelf of this disclosure utilize the design of the trapezoidal holes of the post components and the inclination of the slope pieces of the hook pieces to have the hook pieces to tightly engage the corresponding trapezoidal holes along the upright assembly direction, such that the purpose of rapid assembly and structuring stability can be obtained.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
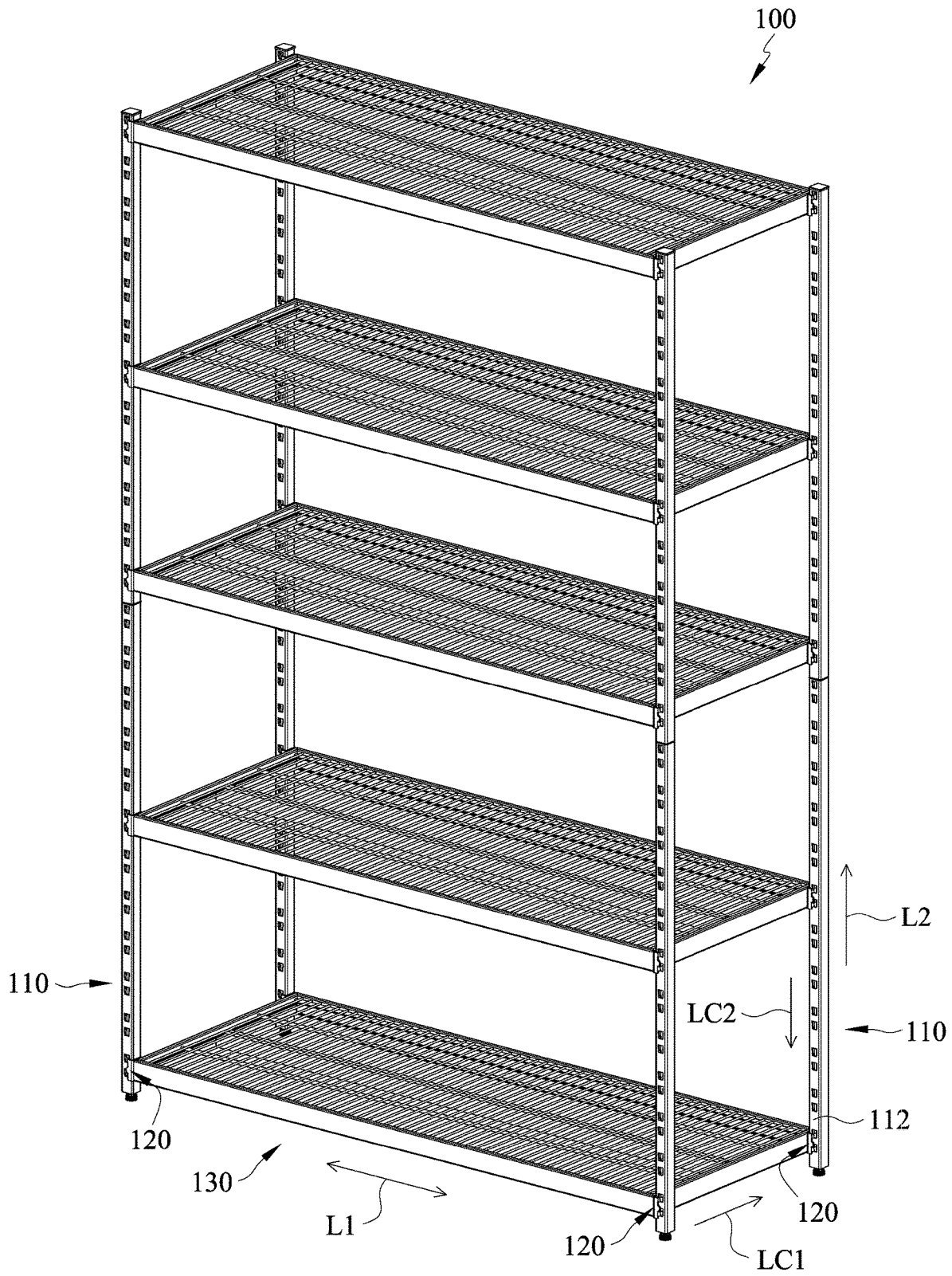
FIG. 1 is a schematic view of the screw-less and no rivet combined type shelf in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments listed below are described in detail with accompanying drawings, but these embodiments are not intended to limit the scope of the present disclosure. In addition, the accompanying drawings are for illustration purposes only and are not drawn according to the original dimensions. In order to facilitate understanding, the same components will be labeled with the same symbols in the following description.

Terms "include", "have", etc. mentioned in this disclosure are all open terms, which means simply "include but not limited to".

In the description of different embodiments, when terms such as "first", "second", "third", "fourth", etc. are used to describe elements, they are only used to distinguish a plurality of elements from each other, and do not limit order or importance of these elements.

In the description of different embodiments, the so-called "couple" or "connect" may refer to two or more elements that are in direct physical or electrical contact with each other, or that are in indirect physical or electrical contact with each other, and may also refer to the mutual operation or action of two or more elements.

FIG. 1 is a schematic view of the screw-less and no rivet combined type shelf in accordance with this disclosure. Referring to FIG. 1, in this embodiment, the screw-less and no rivet combined type shelf 100 includes a plurality of post components 110, a plurality of connecting components 120, and plural storage layers 130. In FIG. 1, a total of four post components 110 are shown, in which the neighboring two post components 110 in the front are spaced to each other by a distance, the other two neighboring post components 110 in the rear are also spaced to each other by the same distance, and the two neighboring post components 110 along either side are separated by another distance. As such, the plurality of post components 110 can be arranged into a preferable rectangular form or any arbitrary form. The plurality of storage layers arranged among these post components 110 separately along a stacking direction L2. The plurality of connecting components 120 are used for mounting the storage layers 130 into the inner space defined by the plurality of post components 110. Thereupon, versatile screw-less and no rivet combined type shelves 100.

Figure 2A:
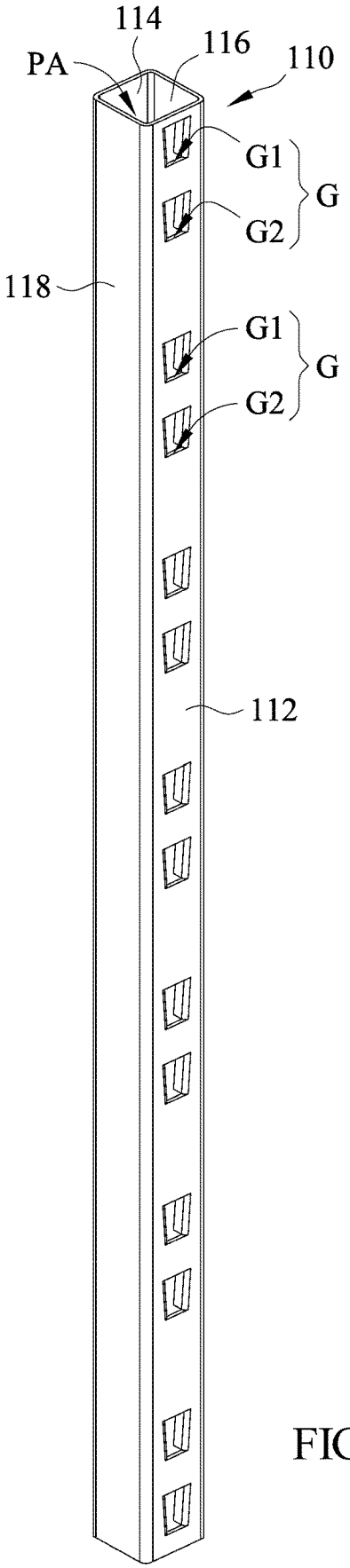
FIG. 2A is a schematic view of the post component of FIG. 1.
Figure 2B:
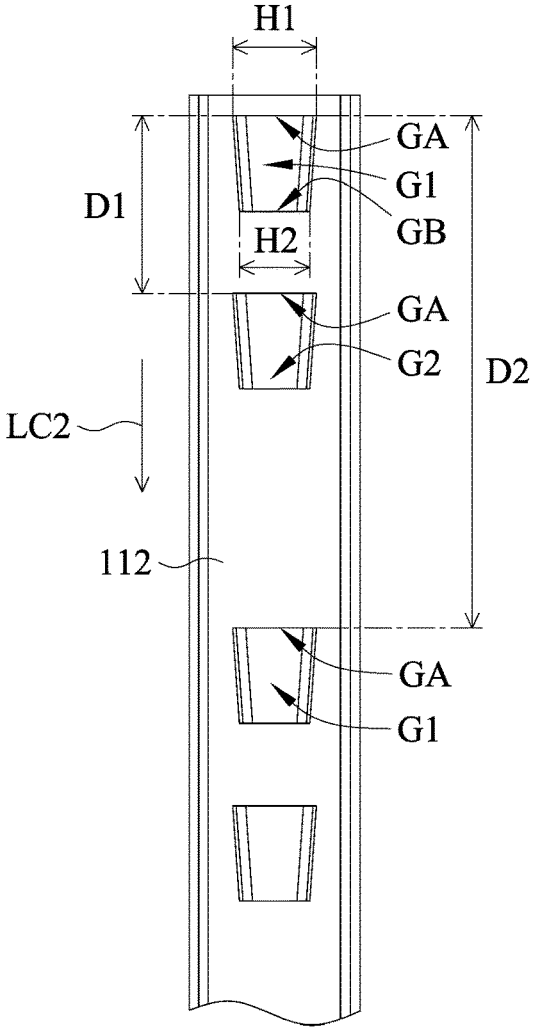
FIG. 2B is another view of a portion of FIG. 2A.
Figure 3:
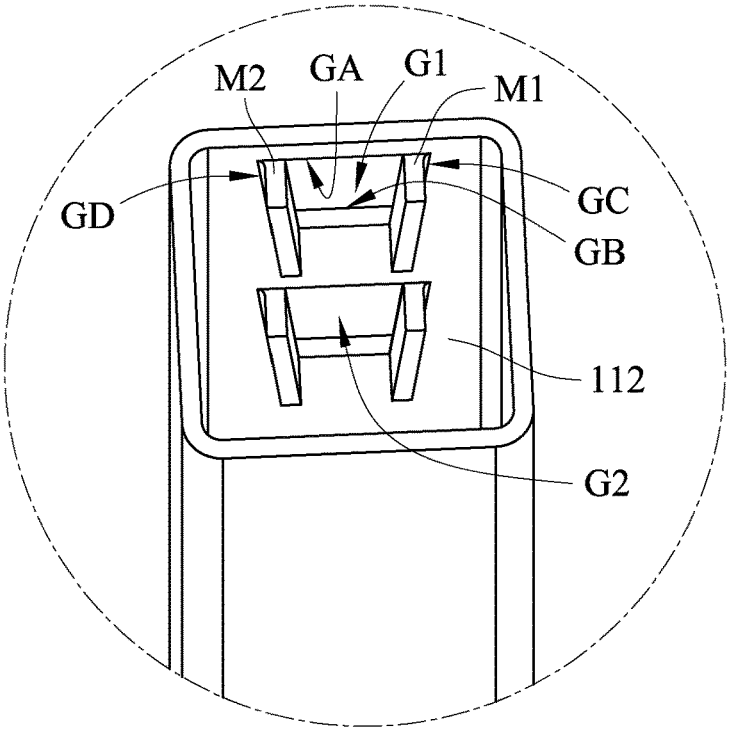
FIG. 3 shows schematically an interior of the post component of FIG. 1.
Figure 4:
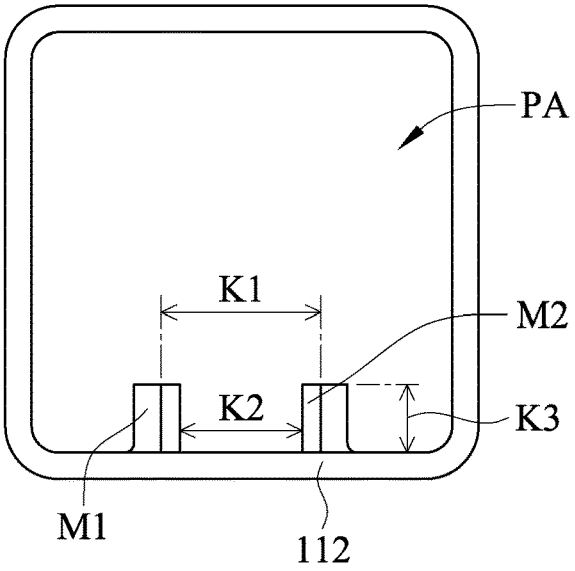
FIG. 4 is another view of FIG. 3.

FIG. 2A is a schematic view of the post component of FIG. 1. FIG. 2B is another view of a portion of FIG. 2A. FIG. 3 shows schematically an interior of the post component of FIG. 1. FIG. 4 is another view of FIG. 3. Referring to FIG. 1 to FIG. 4, the post component 110 of this embodiment includes four plates (i.e., a first plate 112, a second plate 116, a third plate 114 and a fourth plate 118), a plurality of trapezoidal holes G (each thereof includes a first trapezoidal hole G1 and a second trapezoidal hole G2), a plurality of first bent plates M1 and a plurality of second bent plates M2. The first plate 112 and the third plate 114 are parallel to each other. The second plate 116 and the fourth plate 118 are parallel to each other. The first plate 112 is connected to the second plate 116, the second plate 116 is connected to the third plate 114, the third plate 114 is connected to the fourth plate 118, the fourth plate 118 is connected back to the first plate 112, and thus these four plates can be integrated together so as to form a square tube having a hollow space PA. The trapezoidal hole G is provided to one of these four plates; for example, the first plate 112 in this embodiment. However, for a concise explanation in the following description, in this embodiment, the trapezoidal hole G is furnished at the first plate 112, and the first trapezoidal hole G1 and the second trapezoidal hole G2 are integrated as a hole set of the trapezoidal hole G, any two neighboring trapezoidal holes G are separated by the same distance, and the trapezoidal holes G are orderly arranged in a vertical manner.

The first trapezoidal hole G1 along an upright assembly direction LC2 has a top side GA and a bottom side GB, in which a first width H1 of the top side GA is greater than a second width H2 of the bottom side GB. Namely, in the upright assembly direction LC2, the first trapezoidal hole G1 is shaped as a trapezoid having a wider upper end. Similarly, the second trapezoidal hole G2 would be shaped the same as the first trapezoidal hole G1. In addition, the top side GA of the first trapezoidal hole G1 is spaced from the top side GA of the second trapezoidal hole G2 by a first distance D1, the top side GA of the first trapezoidal hole G1 is spaced from another top side GA of the next first trapezoidal hole G1 by a second distance D2, and the distance between the second trapezoidal hole G2 and the upper first trapezoidal hole G1 is less than that between the second trapezoidal hole G2 and the lower first trapezoidal hole G2.

The first bent plate M1 and the second bent plate M2 are individually bent into the first trapezoidal hole G1 (and the second trapezoidal hole G2), and the first bent plate M1 and the second bent plate M2 are individually bent and extended into an inner surface of the first plate 112 from a first side GC and a second side GD of the first trapezoidal hole G1, respectively, such that the first bent plate M1 and the second bent plate M2 can be both located in the hollow space PA. For example, either of the first bent plate M1 and the second bent plate M2 can be an internal plate bent from an exterior surface of the first plate 112, and each of the first bent plate M1 and the second bent plate M2 has a protrusive length K3.

The first bent plate M1 and the second bent plate M2 are both obliquely disposed to match the wide-top trapezoidal hole G. For example, the first bent plate M1 and the second bent plate M2 are oppositely disposed, and a top end of the first bent plate M1 (close to the top side GA of the first trapezoidal hole G1) and a corresponding top end of the second bent plate M2 (close to the top side GA of the first trapezoidal hole G1) are separated by a distance K1 greater than a distance K2 between a bottom end of the first bent plate M1 (close to the bottom side GB of the first trapezoidal hole G1) and a corresponding bottom end of the second bent plate M2 (close to the bottom side GB of the first trapezoidal hole G1). Obviously, both the first bent plate M1 and the second bent plate M2 are individually slope pieces.

Figure 5:
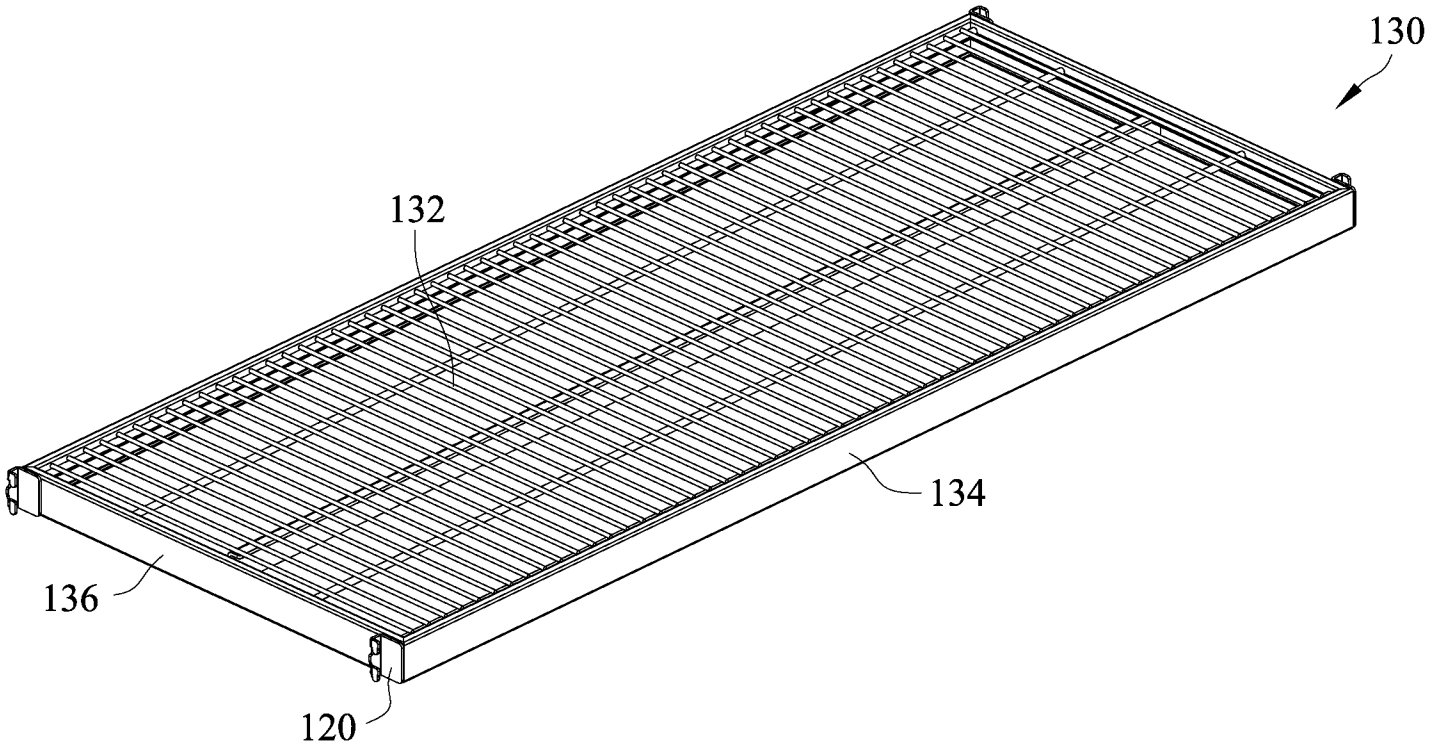
FIG. 5 shows schematically the disposition of the connecting components at the storage layer of FIG. 1.
Figure 8:
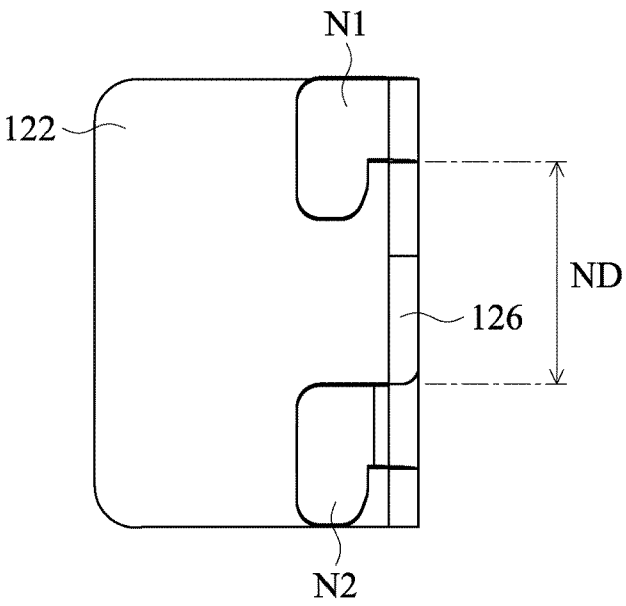
FIG. 8 is another side view of FIG. 6.
Figure 7:
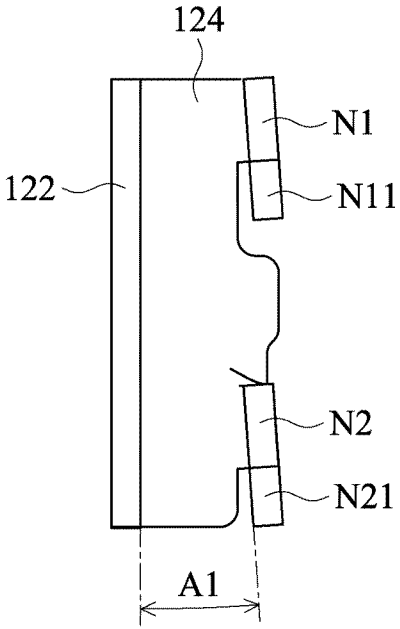
FIG. 7 is a side view of FIG. 6.
Figure 6:
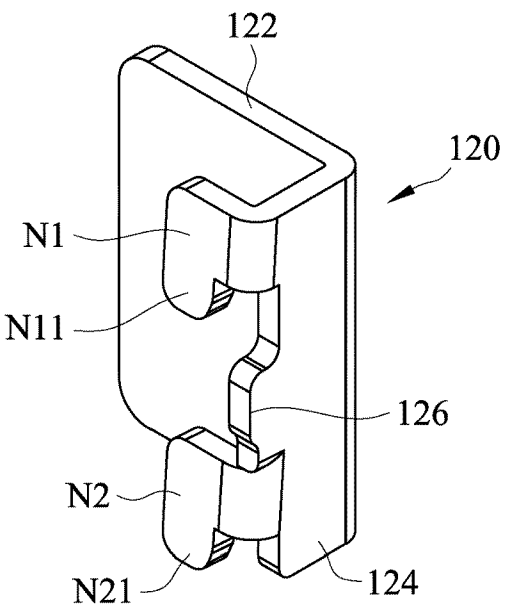
FIG. 6 is a schematic view of the connecting component of FIG. 1.

FIG. 5 shows schematically the disposition of the connecting components at the storage layer of FIG. 1. FIG. 6 is a schematic view of the connecting component of FIG. 1. FIG. 7 is a side view of FIG. FIG. 8 is another side view of FIG. 6. Referring to FIG. 1, FIG. 5 to FIG. 8, the storage layers 130 of this embodiment includes a grid 132, two first transverse members 134, and two second transverse members 136, in which the two first transverse members 134 are respectively disposed to a front side and a rear side of the grid 132, the two second transverse members 136 are respectively disposed to a left side and a right side, and the first transverse member 134 is longer than the second transverse member 136. The connecting components 120 are disposed to opposite sides of the second transverse member 136, such that these four connecting components 120 can be fallen into four corners of the storage layer 130.

The connecting component 120 includes a fixing piece 122, a bent connecting piece 124, a first hook piece N1, a second hook piece N2 and a resisting piece 126. The fixing piece 122 fixed to one of the opposite ends of the second transverse member 136 is to assemble the connecting component 120 to the storage layer 130. A side of the bent connecting piece 124 is connected with the fixing piece 122, while another end thereof is connected to the first hook piece N1 and the second hook piece N2 so as to form a U-shape part. The bent connecting piece 124 is bent and extended from a side of the fixing piece 122, the first hook piece N1 and the second hook piece N2 are individually bent and extended from a side of the bent connecting piece 124, and the first hook piece N1 and the second hook piece N2 are separated by a distance ND. The resisting piece 126 is connected to and also extended from a side of the bent connecting piece 124, and the resisting piece 126 is disposed between the first hook piece N1 and the second hook piece N2.

In one embodiment, the first hook piece N1 and the second hook piece N2 are both oblique pieces. The first hook piece N1 and the second hook piece N2 are individually separated from the fixing piece 122 by a distance. In addition, the first hook piece N1 and the second hook piece N2 are individually not parallel to the fixing piece 122, such that each of the first hook piece N1 and second hook piece N2 can form an inclined angle A1 with respect to the fixing piece 122. In some other embodiments, only one hook piece is included.

Figure 10:
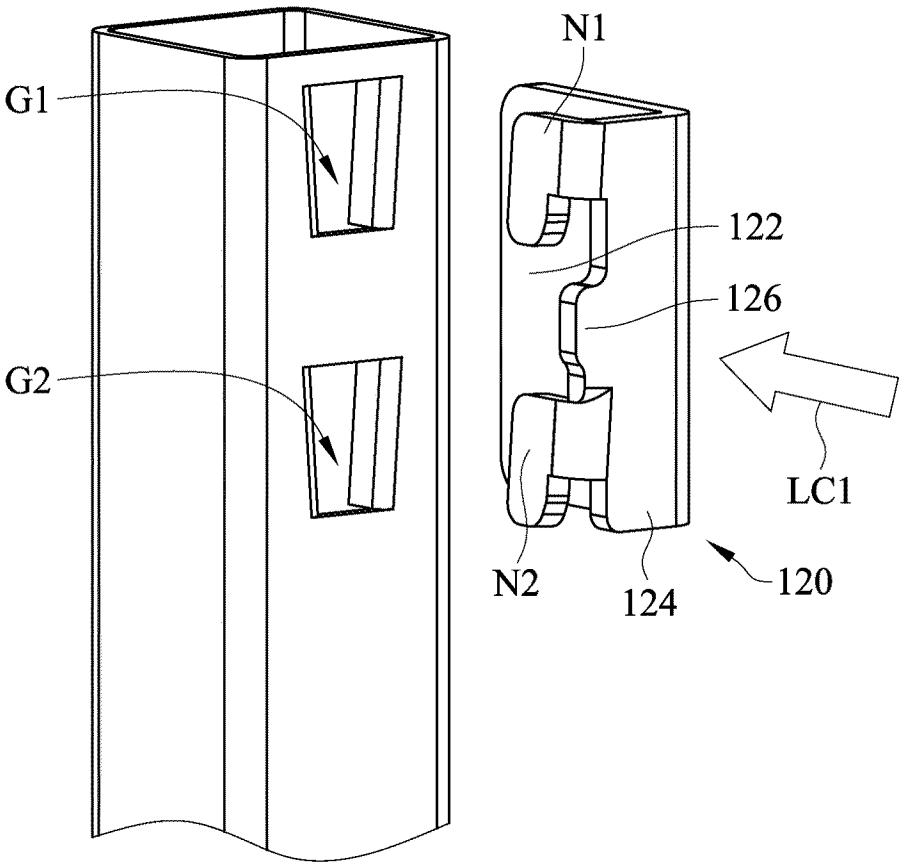
FIG. 10 is a schematic perspective view of FIG. 9.
Figure 9:
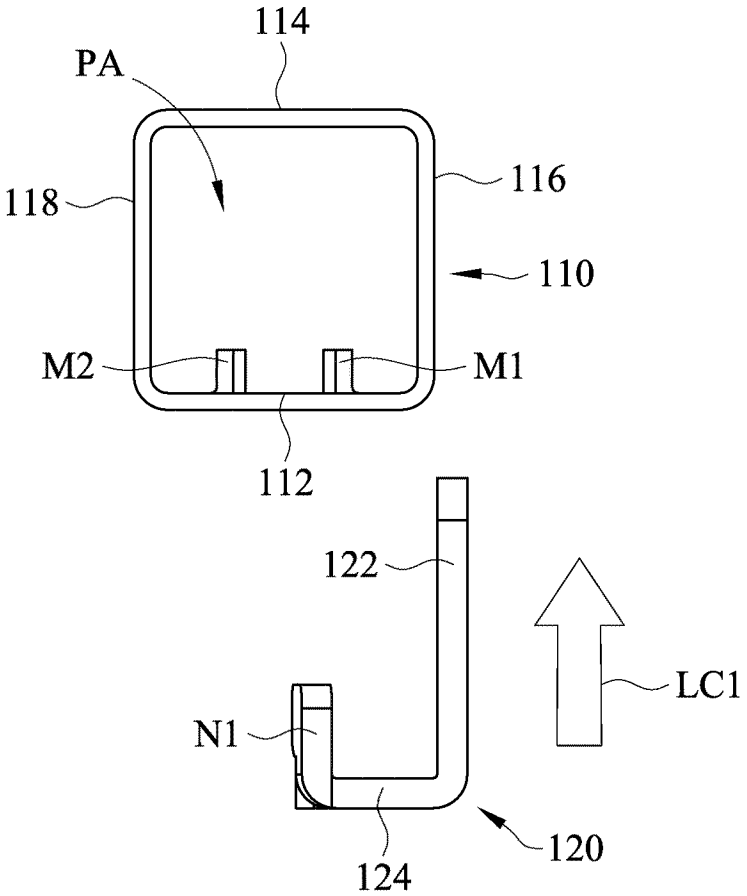
FIG. 9 demonstrates schematically a step of assembling the connecting component to the post component.
Figure 12:
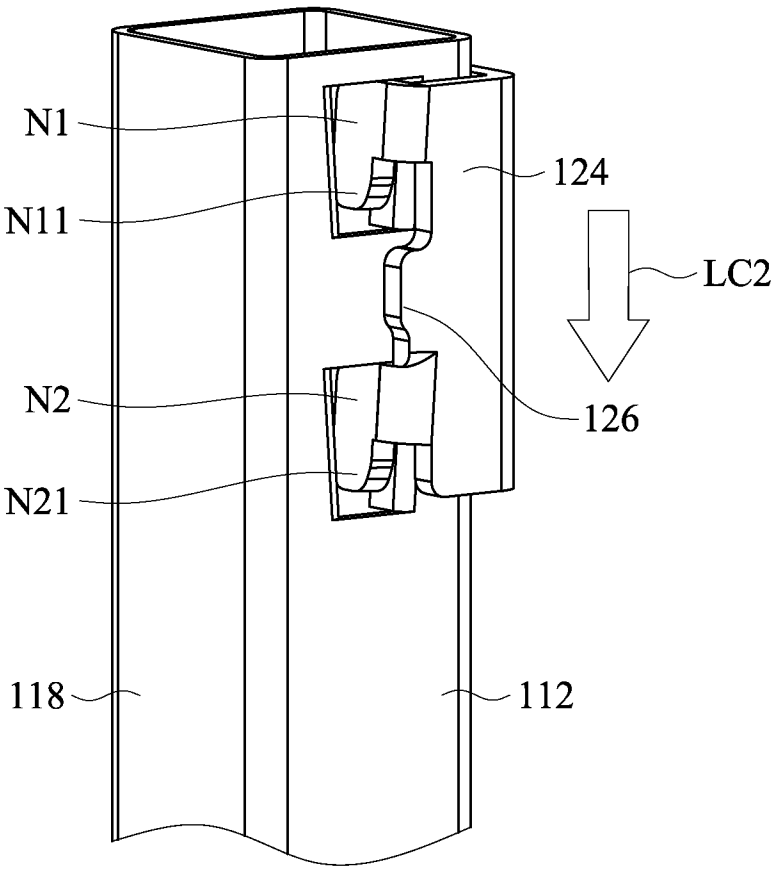
FIG. 11 and FIG. 12 show schematically and individually how the hook pieces of the connecting component can be inserted into the corresponding trapezoidal holes in accordance with this disclosure.
Figure 11:
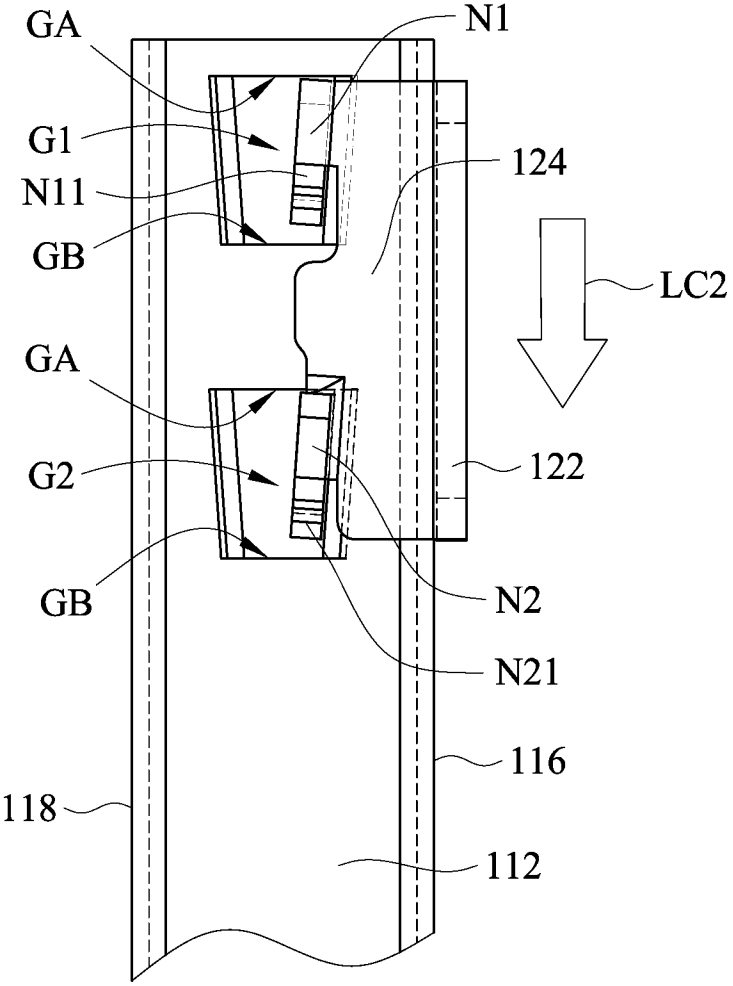

In the following description, FIG. 9 to FIG. 17 are utilized to elucidate the assembly process of this disclosure. In order to explain concisely, FIG. 9 to FIG. 16 do not show the storage layers of FIG. 1. Firstly, as shown in FIG. 9 and FIG. 10, the connecting component 120 is moved toward along an assembly direction LC1. The assembly direction LC1 is guided to the first trapezoidal hole G1 and the second trapezoidal hole G2 of the first plate 112 of the post component 110, with the first hook piece N1 to face the first trapezoidal hole G1, and the second hook piece N2 to face the second trapezoidal hole G2. Then, in FIG. 11 and FIG. 12, the first hook piece N1 is inserted into the first trapezoidal hole G1, and the second hook piece N2 is inserted into the second trapezoidal hole G2. The resisting piece 126 disposed on an outer surface of the first plate 112 of the post component 110, and the fixing piece 122 is to contact an outer surface of the second plate 116 of the post component 110.

Figure 14:
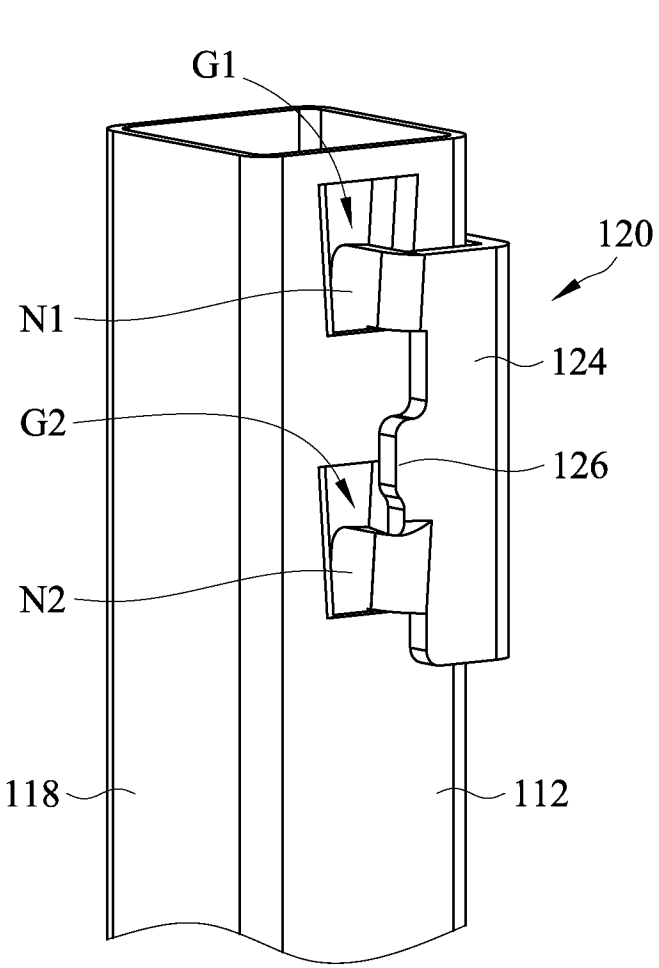
FIG. 13 and FIG. 14 show schematically and individually how the hook pieces of the connecting component can be buckled into the post component along the upright assembly direction in accordance with this disclosure.
Figure 13:
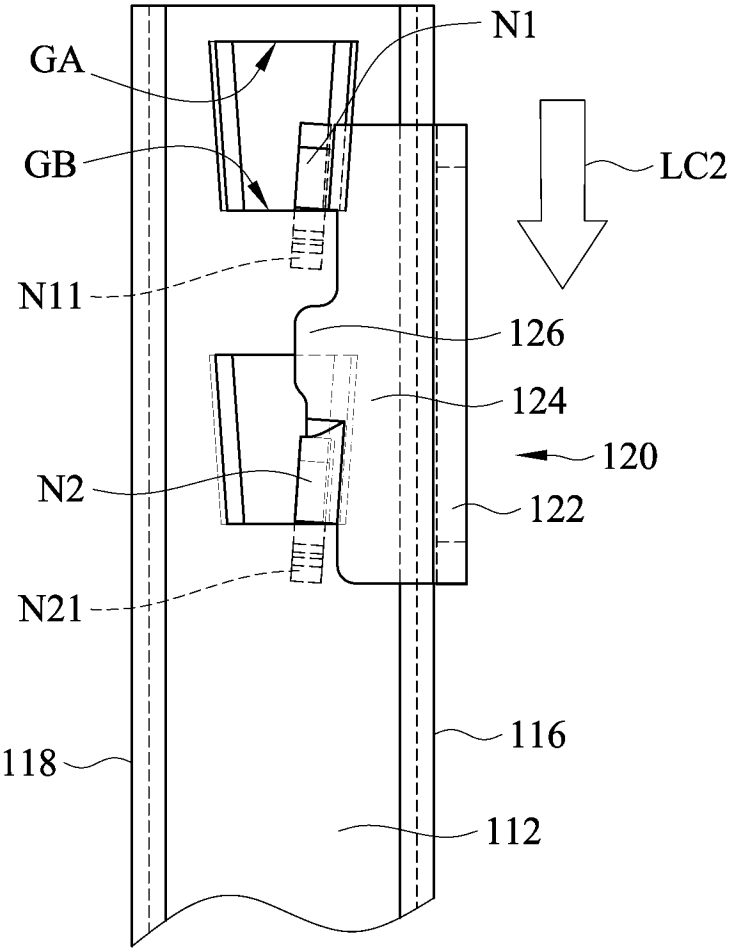
Figure 15:
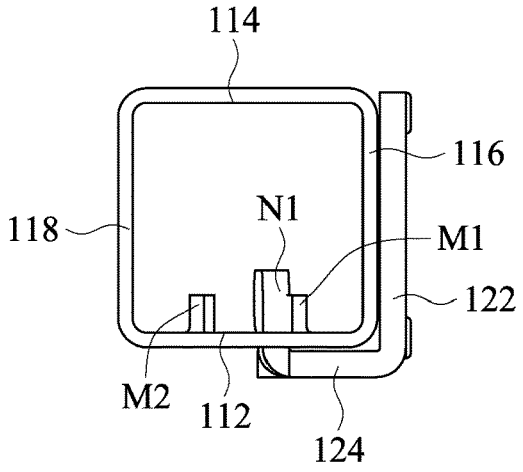
FIG. 15 shows schematically the state that the connecting component is assembled in the post component in accordance with this disclosure.
Figure 16:
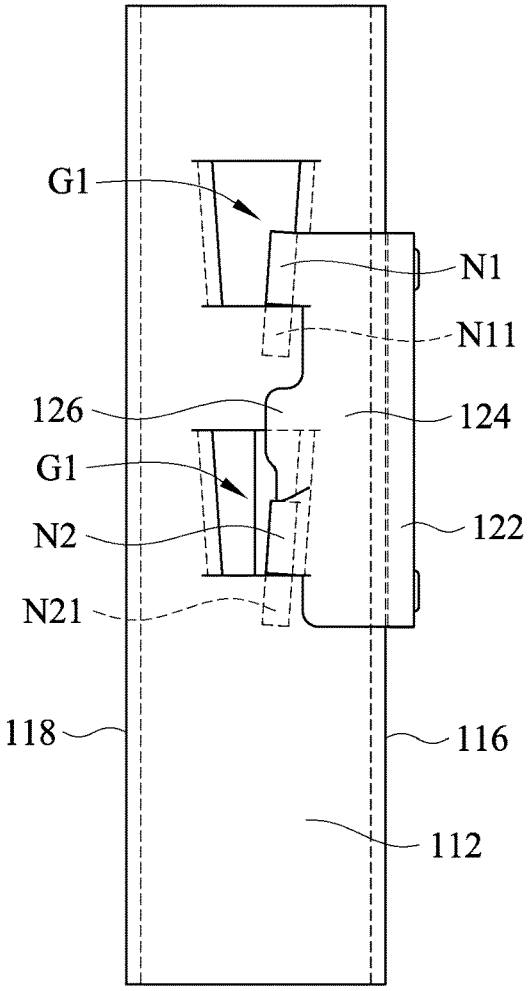
FIG. 16 is a schematic view showing that the connecting component is assembled in the post component in accordance with this disclosure.
Figure 17:
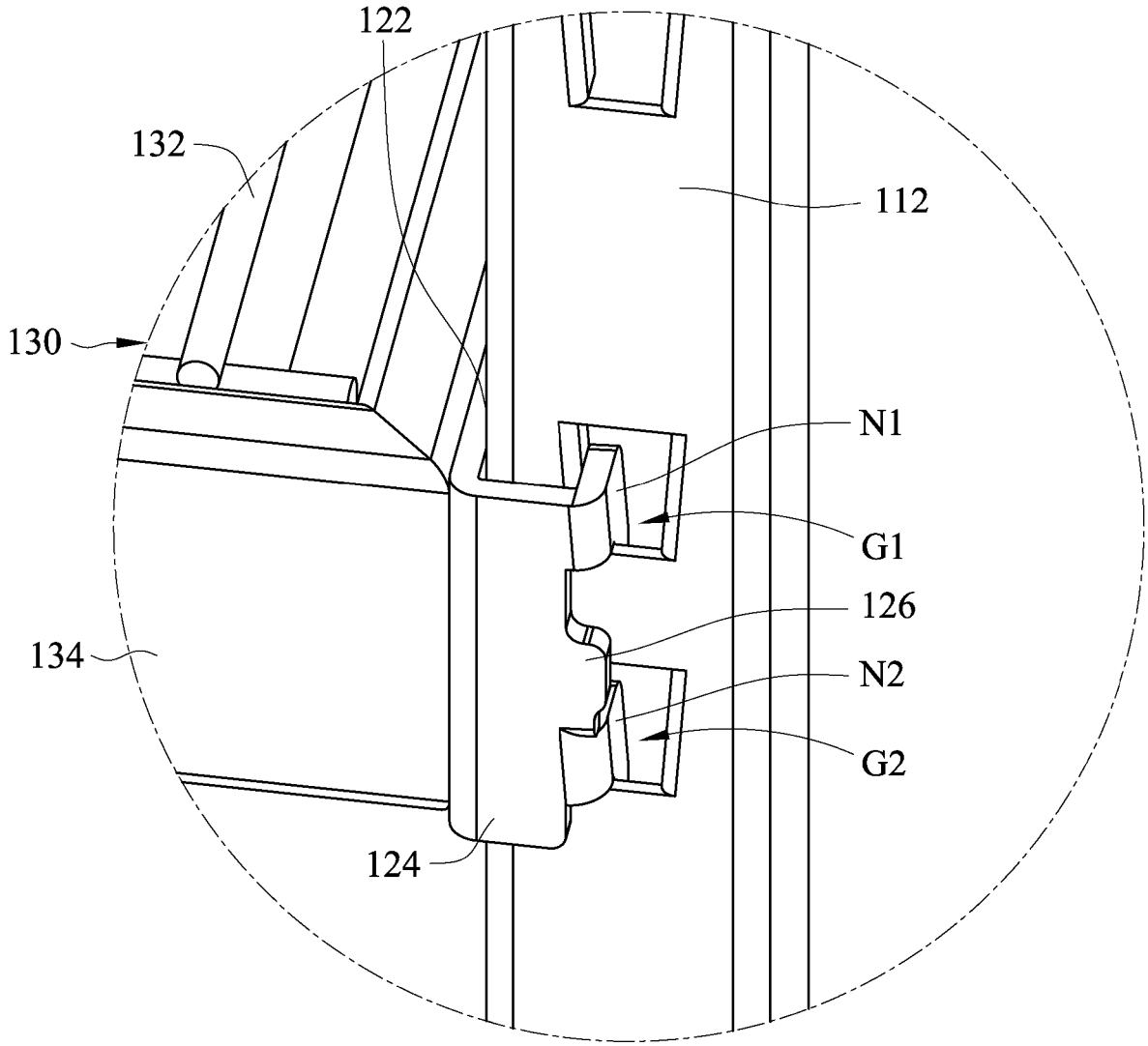
FIG. 17 demonstrates schematically how the connecting component can assemble the storage layer to the post components in accordance with this disclosure.

Then, in FIG. 13 and FIG. 14, the connecting component 120 is depressed down along the upright assembly direction LC2 (i.e., a downward application) so as to have the first hook piece N1 to buckle the first trapezoidal hole G1 and the second hook piece N2 to buckle the second trapezoidal hole G2, respectively. In the downward assembling of the connecting component 120 along the upright assembly direction LC2, since both the first trapezoidal hole G1 and the second trapezoidal hole G2 are wide-top trapezoidal hole designs, thus the first hook piece N1 and the second hook piece N2 would be designed accordingly. As shown in FIG. 15 and FIG. 16, along with the first hook piece N1 and the second hook piece N2 to move in the upright assembly direction LC2, the first hook piece N1 and the second hook piece would be tightly fitted by the first trapezoidal hole G1 and the second trapezoidal hole G2, respectively. Thereupon, the assembly is obviously convenient. Also, through the structuring match, the connecting component 120 can be firmly assembled to the post component 110, as shown in FIG. 17. Namely, the storage layer 130 can be assembled to the post component 110.

Figure 18:
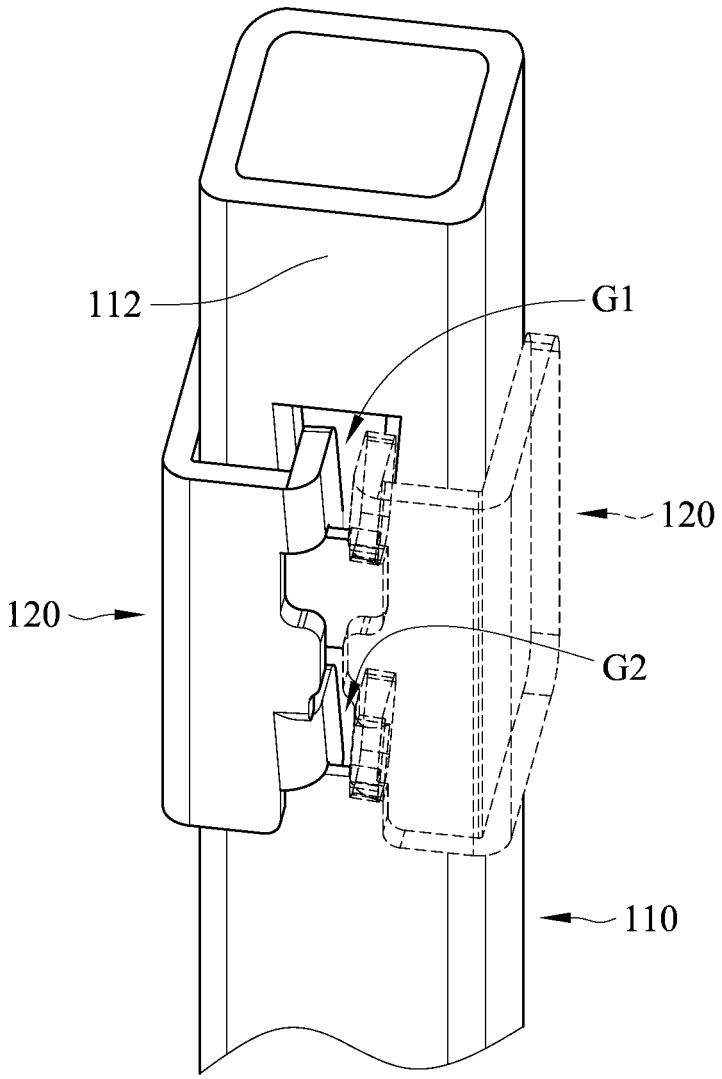
FIG. 18 demonstrates schematically how two connecting components can be mounted to the same hook piece in accordance with this disclosure.

As shown, the first hook piece N1 and the second hook piece N2 are respectively contacted at the first bent plate M1, and the extension piece N11 and the extension piece N21 of the second hook piece N2 are respectively disposed inner the first plate 112. In addition, as shown in FIG. 16, the first trapezoidal hole G1 and the second trapezoidal hole G2 still have rooms for another connecting component 120 to engage, as shown in FIG. 18, for horizontal extension or further assembly of the screw-less and no rivet combined type shelf 100 of FIG. 1 along the horizontal direction L1, and thus the assembly convenience can be substantially enhanced.

Figure 19:
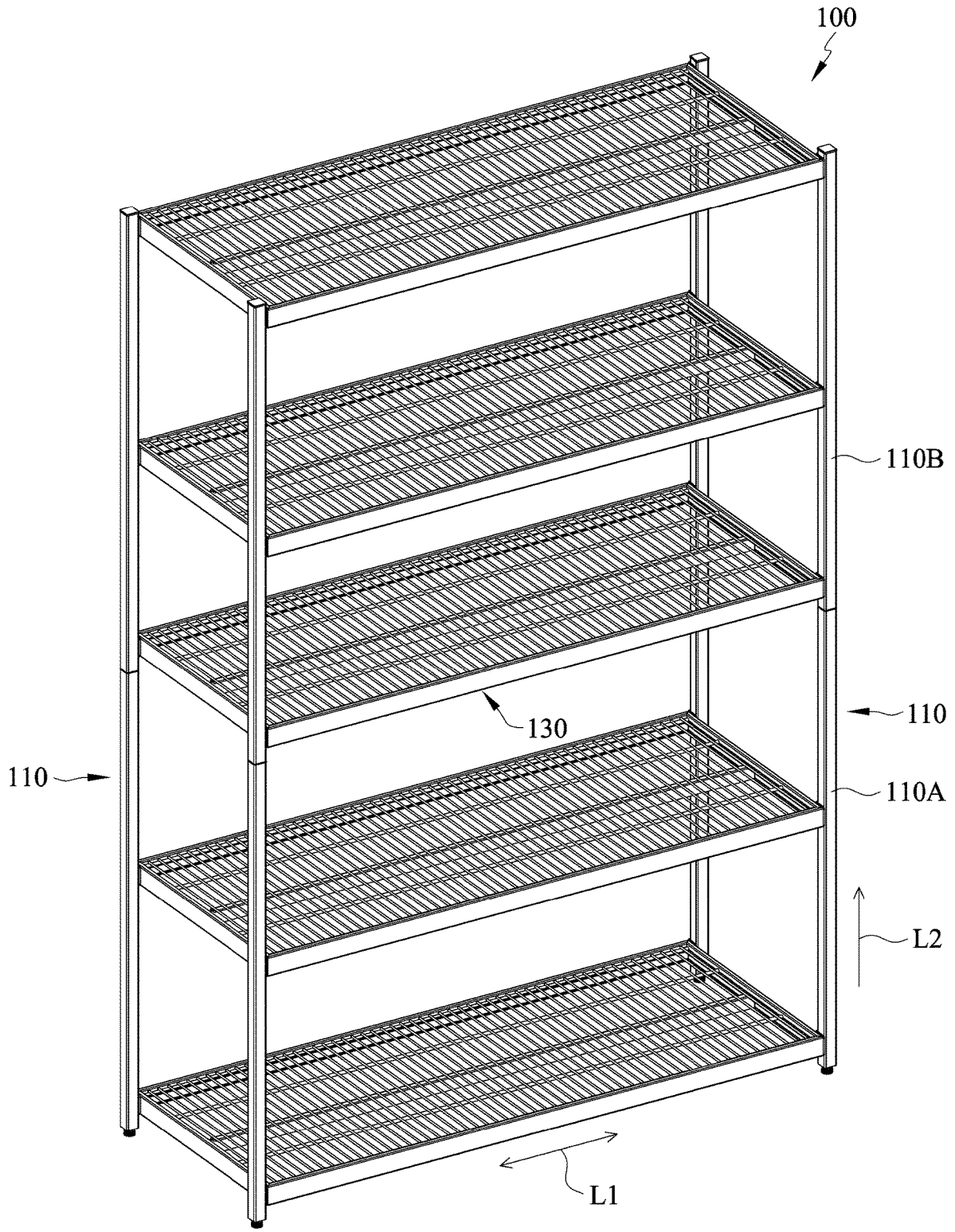
FIG. 19 is another view of FIG. 1.
Figure 20:
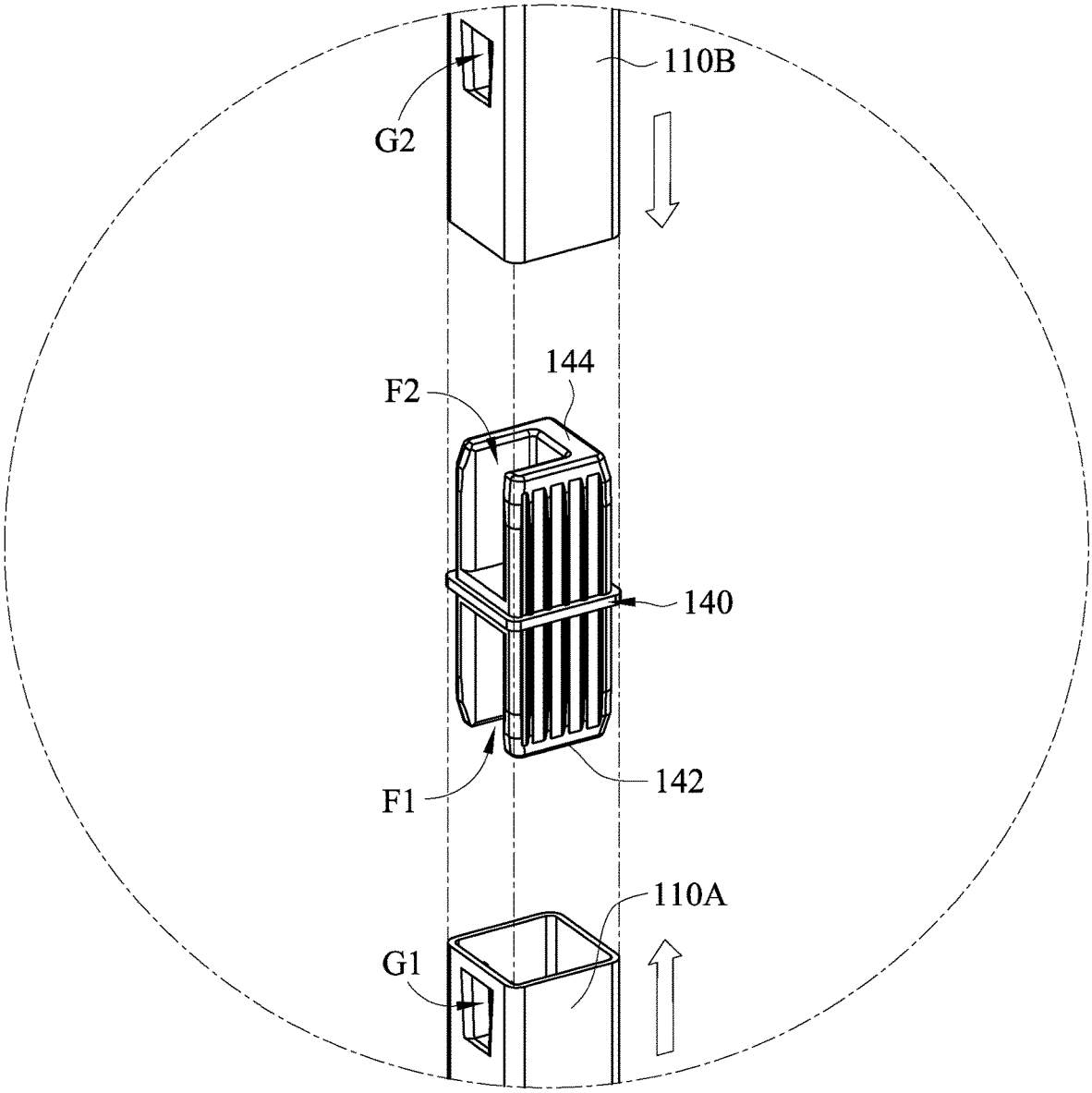
FIG. 20 is a schematic exploded view showing the connection of two post components along the stacking direction.

FIG. 19 is another view of FIG. 1. FIG. 20 is a schematic exploded view showing the connection of two post components along the stacking direction. Referring to FIG. 19 and FIG. 20, where FIG. 19 is a rear side view of FIG. 1. The post components 110 along the stacking direction L2 can be divided into the first post components 110A and the second post components 110B, and the second post components 110B is located above the first post components 110A. In one embodiment, a connector 140 can be used to connect linearly the first post component 110A and the second post component 110B in the stacking direction L2, so as to reach a desired height of the screw-less and no rivet combined type shelf 100. For example, the connector 140 includes a first protruded end 142 and second protruded end 144. The first protruded end 142 is to be plugged into the first post component 110A, and the second protruded end 144 is to be plugged into the second post component 110B. The first protruded end 142 has an empty space F1 for exposing the first trapezoidal hole G1, and the second protruded end 144 has another empty space F2 for exposing the second trapezoidal hole G2.

In summary, the screw-less and no rivet combined type shelf of this disclosure utilize the design of the trapezoidal holes of the post components and the inclination of the slope pieces of the hook pieces to have the hook pieces to tightly engage the corresponding trapezoidal holes along the upright assembly direction, such that the purpose of rapid assembly and structuring stability can be obtained.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A screw-less and no rivet combined type shelf, comprising:

a plurality of post components, each of the plurality of post components including four plates, a plurality of trapezoidal holes and at least one bent plate, the four plates being connected together, the plurality of trapezoidal holes being disposed at one of the four plates, each of the at least one bent plate being bent into one corresponding trapezoidal hole of the plurality of trapezoidal holes;

at least one storage layer; and a plurality of connecting components, each of the plurality of connecting components being disposed to one corresponding storage layer of the at least one storage layer, the plurality of connecting components being to assemble each of the at least one storage layer within the plurality of post components, each of the plurality of connecting components including at least one hook piece as a slope piece;

wherein, when each of the at least one hook piece is inserted into the corresponding trapezoidal hole in an upright assembly direction, each of the plurality of hook pieces is buckled in the corresponding trapezoidal hole; and wherein each of the plurality of connecting components includes a fixing piece and a bent connecting piece, a side of the bent connecting piece is connected to the fixing piece, another side of the bent connecting piece is connected to the hook piece, and the hook piece and the fixing piece are separated by a distance.

2. The screw-less and no rivet combined type shelf of claim 1, wherein each of the plurality of trapezoidal holes has a first width and a second width in the upright assembly direction, and the first width is greater than the second width.

3. The screw-less and no rivet combined type shelf of claim 1, wherein each of the at least one bent plate is a slope piece.

4. The screw-less and no rivet combined type shelf of claim 1, wherein the hook piece includes a first hook piece and a second hook piece, and the first hook piece and the second hook piece are separated by a distance.

5. The screw-less and no rivet combined type shelf of claim 1, wherein the hook piece is not parallel to the fixing piece.

6. The screw-less and no rivet combined type shelf of claim 1, wherein each of the plurality of connecting components includes a resisting piece, and the resisting piece connects with and extends from a side of the bent connecting piece.

* * * * *